US005644962A

United States Patent [19]

Koponen et al.

[11] Patent Number: 5,644,962

[45] Date of Patent: *Jul. 8, 1997

[54] DRYER SECTION OF A PAPER OR BOARD MACHINE INCLUDING AN ARRANGEMENT FOR CUTTING A LEADER OF THE WEB

[75] Inventors: Ismo Koponen; Ilmari Rintasalo; Jari Vainio, all of Rauma; Juha Kaihovirta, Jyväskylä, all of Finland

[73] Assignee: Valmet Corporation, Helsinki, Finland

[ * ] Notice: The term of this patent shall not extend beyond the expiration date of Pat. No. 5,445,055.

[21] Appl. No.: 206,533

[22] Filed: Mar. 4, 1994

Related U.S. Application Data

[63] Continuation-in-part of Ser. No. 81,358, filed as PCT/FI92/00311, Nov. 18, 1992, Pat. No. 5,445,055.

[30] Foreign Application Priority Data

Nov. 19, 1991 [FI] Finland ..... 915450

[51] Int. Cl.[6] ..... B26F 3/00; D21F 5/04

[52] U.S. Cl. ..... 83/177; 83/53; 34/117; 162/194; 162/286

[58] Field of Search ..... 83/53, 177; 162/193, 162/194, 195, 286; 34/117, 120

[56] References Cited

U.S. PATENT DOCUMENTS

| | | | |
|---|---|---|---|
| 4,566,944 | 1/1986 | Mauranen et al. | 162/193 X |
| 4,931,140 | 6/1990 | Peltola et al. | 162/195 X |
| 5,068,513 | 11/1991 | Gangemi | 219/121.67 |
| 5,248,390 | 9/1993 | Fissmann et al. | 162/193 |
| 5,445,055 | 8/1995 | Koponen et al. | 83/177 X |

FOREIGN PATENT DOCUMENTS

| | | |
|---|---|---|
| 2031802 | 5/1991 | Canada . |
| 0444316 | 9/1991 | European Pat. Off. . |
| 88060 | 12/1992 | Finland . |
| 88417 | 1/1993 | Finland . |
| 3924897 | 2/1991 | Germany . |
| 9103359 | 3/1991 | WIPO . |
| 9205931 | 4/1992 | WIPO . |

*Primary Examiner*—Rinaldi I. Rada
*Assistant Examiner*—Raymond D. Woods
*Attorney, Agent, or Firm*—Steinberg, Raskin & Davidson, P.C.

[57] ABSTRACT

An arrangement for cutting the leader of the web in a paper or board machine in the dryer section of the machine by a jet of pressurized water. The web is placed against the drying wire when it is being cut, and the jet is directed at the web from the free side of the web. The water jet pressure used is from about 40 bar to about 400 bar, preferably from about 100 bar to about 350 bar, which is produced by an ordinary pressure washer.

9 Claims, 15 Drawing Sheets

DRYER SECTION OF A PAPER OR BOARD MACHINE INCLUDING AN ARRANGEMENT FOR CUTTING A LEADER OF THE WEB

This application is a continuation-in-part of U.S. Ser. No. 08/081,358 filed as PCT/FI92/00311, Nov. 18, 1992 now U.S. Pat. No. 5,445,055.

BACKGROUND OF THE INVENTION

The present invention relates to the cutting of the leader of the web in a paper or board machine in the drying section of the machine and in cylinder drying sections of on-machine coating machines.

At the present time, a revolving toothed circular blade (circular saw) is used for this purpose in the prior art, in which case the paper web must be separated from the drying wire at the cutting point in order that the blade should not cut the drying wire as well.

In the prior art, a second mode for cutting a web that has been separated from the drying wire is by means of a high-pressure water jet (P > about 400 bar). The required pressure is high, because, with lower pressures, the web that is not supported against the drying wire at the cutting point is torn irregularly, which results in web breaks.

In many paper and board machines, the cutting of the leader of the web is carried out at the so-called wet end of the machine on the Fourdrinier wire or below the so-called pick-up felt in the press section. In these cutting processes, the dry solids content of the web placed on the Fourdrinier wire is from about 10% to about 20%, commonly about 15%. The strength of such a wet web is very low, and it can be cut readily. In the cutting performed in the wet end of a paper and board machine, it is possible to use low pressures in the diagonal cutting. The pressure values are generally from about 10 bar to about 20 bar, more commonly in a range from about 12 bar to about 14 bar.

At the end of the drying section, the dry solids content of the web is from about 90% to about 98%, most commonly about 94% to about 95%. After the drying section of a coater, the dry solids content is commonly from about 96% to about 98%. The strength of such a web is far higher than the strength of a web whose dry solids content is about 20% or less, the latter sort of web being usually cut by means of a water jet.

OBJECTS AND SUMMARY OF THE INVENTION

It is an object of the present invention to provide a new and improved method for cutting a leader of a web and/or a diagonal tail portion of the web.

It is another object of the present invention to provide a new and improved method for cutting the leader of a web and/or the diagonal tail portion of the web in which a water jet pressurized to a pressure between about 40 bar and 400 bar is applied to a free side of the web.

It is yet another object of the present invention to provide a new and improved method and arrangement for cutting the leader of a web and/or the diagonal tail portion of the web in which a water jet pressurized to a pressure between about 40 bar and 400 bar is applied to a free side of the web while the web runs against a face of a cylinder, Vac-roll, paper guide roll, or in a free draw.

It is still another object of the present invention to provide a new and improved method for cutting the leader of a web and/or the diagonal tail portion of the web which is applied in a drying section having a single-wire draw and/or a twin-wire draw.

Briefly, in the method in accordance with the present invention, a plurality of cylinders are arranged in the dryer section. A drying wire carries the web over the cylinders such that the web has at least one free, exposed side on or between the cylinders. A pressurized water jet is directed at the free side of the web to cut the web. The water jet has a pressure from about 40 bar to about 400 bar, preferably from about 100 bar to about 350 bar. At least one movable cutting nozzle can be provided through which the water jet is applied to the web. A pump, e.g., plunger pump or piston pump, can be arranged to pressurize water and direct the pressurized water to the cutting nozzle.

The cutting nozzle is placed in a position to initiate the cutting of the web from an edge of the web and/or from a location between the edges of the web, i.e., in the middle of the width of the web.

In addition, the web may be stabilized by means of a guide plate having an aperture through which the water jet is directed at the web. To this end, nozzles are arranged in the guide plate to direct an air jet in a direction substantially parallel to the running direction of the web. Alternatively, suction may be applied through a coanda plate to stabilize the web whereby the water jet is directed at the web through an aperture in the coanda plate.

The arrangement in accordance with the present invention for cutting a leader of a web and/or a diagonal tail portion of the web in a paper or board machine in a dryer section of the machine, includes a plurality of cylinders, a drying wire for carrying the web meandering over the cylinders so that the web has at least one free, exposed side on or between the cylinders. Means are arranged to direct a pressurized water jet at the free side of the web to cut the web. The water jet has a pressure from about 40 bar to about 400 bar, preferably from 100 bar to about 350 bar. A pump may be arranged to pressurize water and direct the pressurized water to the means. To stabilize the web, if desired, a plate is arranged and has nozzles through which an air jet is directed in a direction substantially parallel to the running direction of the web. The water jet is directed at the web through an aperture in the plate. The means may comprise a cutting nozzle having a variable diameter depending on the type of web being cut, e.g., normally from about 0.1 mm to about 1.5 mm, from about 0.2 mm to about 0.25 mm for use with Sc grades, from about 0.3 mm to about 0.35 mm for fine paper, from about 0.4 mm to about 0.8 mm for liner and heavy pulp webs.

The method in accordance with the present invention has incontestable advantages over the methods that are currently being used. It does not produce cutting dust in the air, which dust is detrimental when it adheres to the paper web and to the equipment in the paper mill. The devices in accordance with the method of the invention are simple and durable, and they require little maintenance. The cutting process does not increase the noise level in the premises to a significant extent. The web is not torn irregularly, nor is it broken because of the cutting, which is of great importance. In the cutting in accordance with some embodiments of the method, the web is not separated from the drying wire, which simplifies and improves the transfer of the web and results in an improved efficiency in the time of utilization of the machine.

By means of the method in accordance with the invention, the leader can be cut, without risk of being torn, by means of a simple and inexpensive low-pressure water jet, whose pressure is of an order of about 100 bar. In one particular embodiment of the present invention, the web is cut while the web runs on the drying wire by means of a pressurized water jet, whose pressure is from about 40 bar to about 400 bar.

The method and arrangement in accordance with the present invention are used in a dryer section, e.g., of the "Sym-Run" type. The web can be cut in an area where the web going upward and/or an area of the paper machine where the web travels in a downward direction, and/or in connection with an open gap.

The cutting of the web or leader of the web can be carried out, in addition to a position whereby the web or leader is placed against the wire, also when the web is placed on the face of a Vac roll, the face of a cylinder, or the face of a paper guide roll or on the face of a roll or an equivalent member arranged for the cutting.

The cutting angle, i.e., the angle of the nozzle in relation to the web, can be inclined at an angle of about ±45° in the transverse and/or longitudinal direction of the web. The cutting angle is, however, preferably arranged in a direction perpendicular to the web.

The high-pressure water is introduced into the cutting nozzle by means of a resilient hose, either all the way from the pump, from the end of the beam for paper-tail cutting, or from the middle of the beam for paper-tail cutting. Preferably, the hose extends immediately from the end of the beam for paper-tail cutting, to which end the pressurized water is supplied from the pump by a metal pipe made of stainless or acid-proof stainless steel. The water may also be stored in a pressure accumulator, which is, e.g., mounted on the sledge for paper-tail cutting.

Around the nozzle, there is a guide plate which supports the web and guides the nozzle from outside the wire into the area of the web. The guide plate can be convex or rounded at its edges unless the beam for paper-tail cutting has a tilting mechanism. Further, around the nozzle, there may also be a coanda plate which is known from prior art technology of the assignee, or a smaller plate modified from an existing plate. The coanda plate can be curved either at one edge or at both edges so as to guide the nozzle past the wire and the web or across the edge of the web when arriving in the area of the web from outside the wire.

The material of the nozzle is a sapphire or a diamond inlaid in steel. Alternatively, it is possible to use nozzles made of a metal, a ceramic, or pyrex glass.

It is another important feature of the present invention that the web can be split by means of other jets, which are switched off before the paper-tail cutting jet arrives at their location, or that the paper-tail cutting is carried out by means two or more jets by using them one after the other.

Further, the method can be used for cutting the leader of the web and/or a diagonal tail portion in the dryer section of the machine either from the edge of the web or elsewhere in the area of the web. Thus, the leader (paper tail) can be cut in a variety of ways: when it is placed against the drying wire, a cylinder, a roll, or against a vac-roll; when it has been separated from the drying wire, e.g., by means of suction (coanda-plate type); that a plate or equivalent has been inserted between the web and the drying wire; or the cutting takes place in a free gap.

The high-pressure center or pump can be placed at the machine level or in the basement, and from the same high-pressure center it is possible to supply one or several paper-tail cutting devices with high-pressure water, either in the same paper machine or in different paper machines.

The sledge for paper-tail cutting is transferred by means of an electric or pneumatic motor or by means of a hand lever, by the intermediate of a chain or belt. Pneumatic cylinders may also be used for the transfer of the sledge for paper-tail cutting. However, their maximum length is about 6 meters, and their cost is relatively high.

In a preferred embodiment, instead of a pivotal beam, the sledge for paper-tail cutting may also be provided with a pivotal nozzle/guide-plate construction.

In the prior art, water jet cutting is carried out by using a water pressure which is substantially higher than in the present invention, e.g., in a range from about 850 bar to about 4000 bar as described in International Patent Application WO 91/03359 and Canadian Patent Application No. 2,031,802. In the present invention, the water jet pressure is about one order of magnitude lower than in the prior art, e.g., from about 40 bar to about 400 bar. This lower operating pressure provides an advantage that the water cutting devices can be manufactured at a substantially lower apparatus costs which are reduced 5–10% of the construction costs of prior art water cutting devices. This drop in apparatus costs enables an auxiliary system to be applied in the present invention, if needed, so that two systems which are either partially or completely parallel and/or overlapping can be utilized and still result in lower construction costs. The double system ensures that malfunctions do not cause the paper machine downtime or that downtime periods will be shorter than without such a parallel system.

When cutting a leader, the quality of the edge cutting result is not very significant and the low water jet pressure applied in the present invention provides a satisfactory cutting result.

It is another advantage of the present invention that the lower water jet pressure enables the web or leader to be cut while running against a face of a cylinder, either running on a wire or not, i.e., the case where the web runs directly on a cylinder. In the prior art, the higher water jet pressures quickly damage the surfaces of the cylinder, and therefore cannot be applied when the web runs on the cylinder surface.

In the following, the invention will be described in detail with reference to some exemplifying embodiments of the invention illustrated in the figures in the accompanying drawing. However, the invention is not confined to the details of these embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
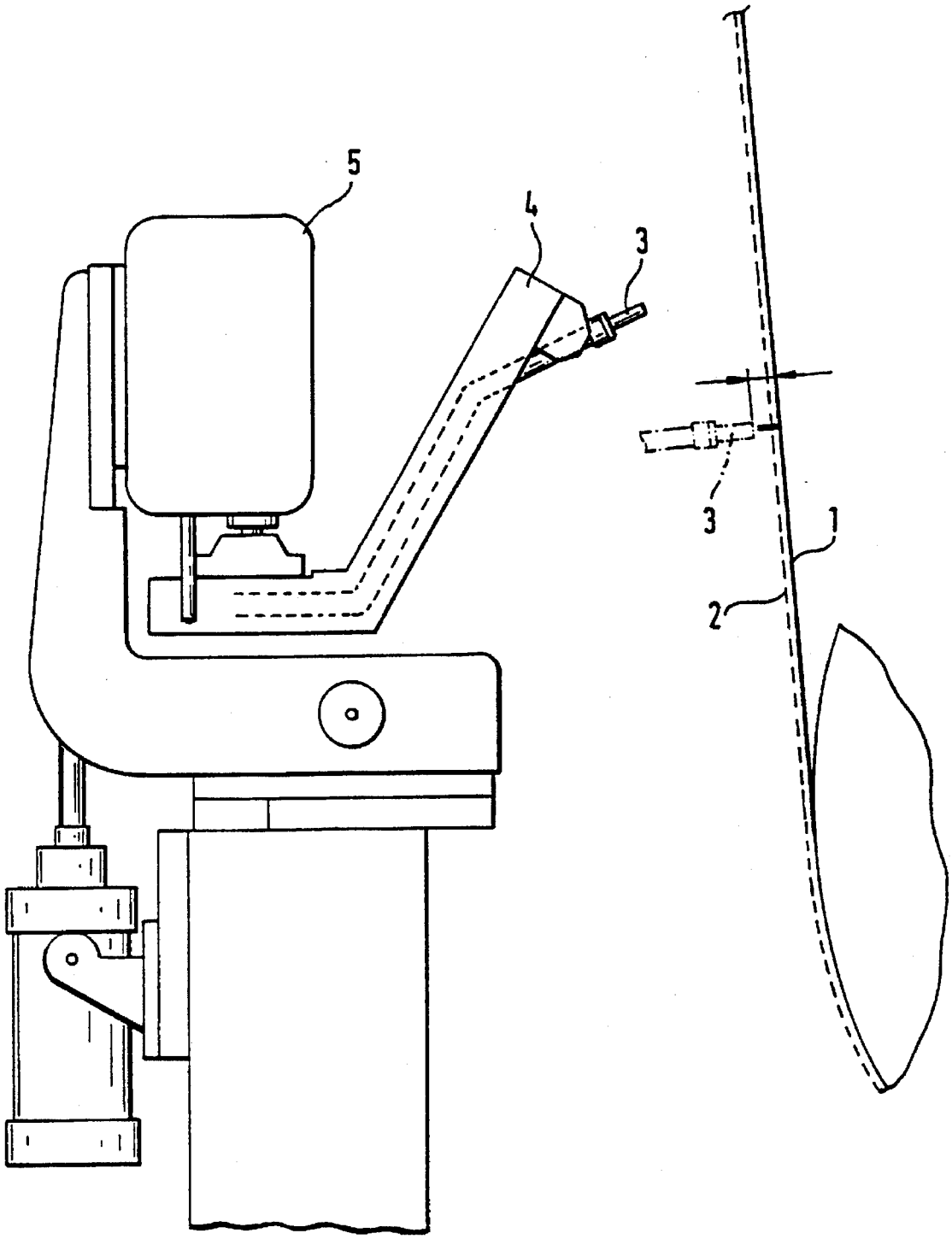
FIGS. 1, 2, 3, 4, and 5 show a water jet device and method in accordance with the present invention for cutting of the leader as viewed from the side of the paper machine.
Figure 2:
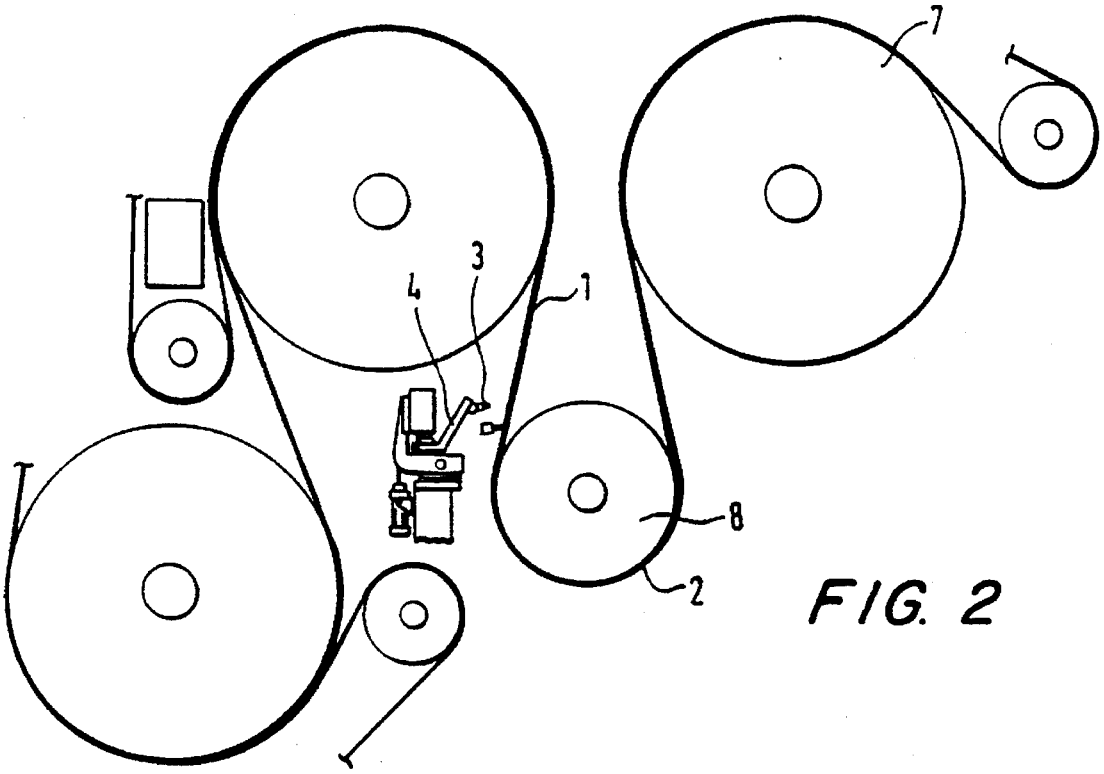
Figure 3:
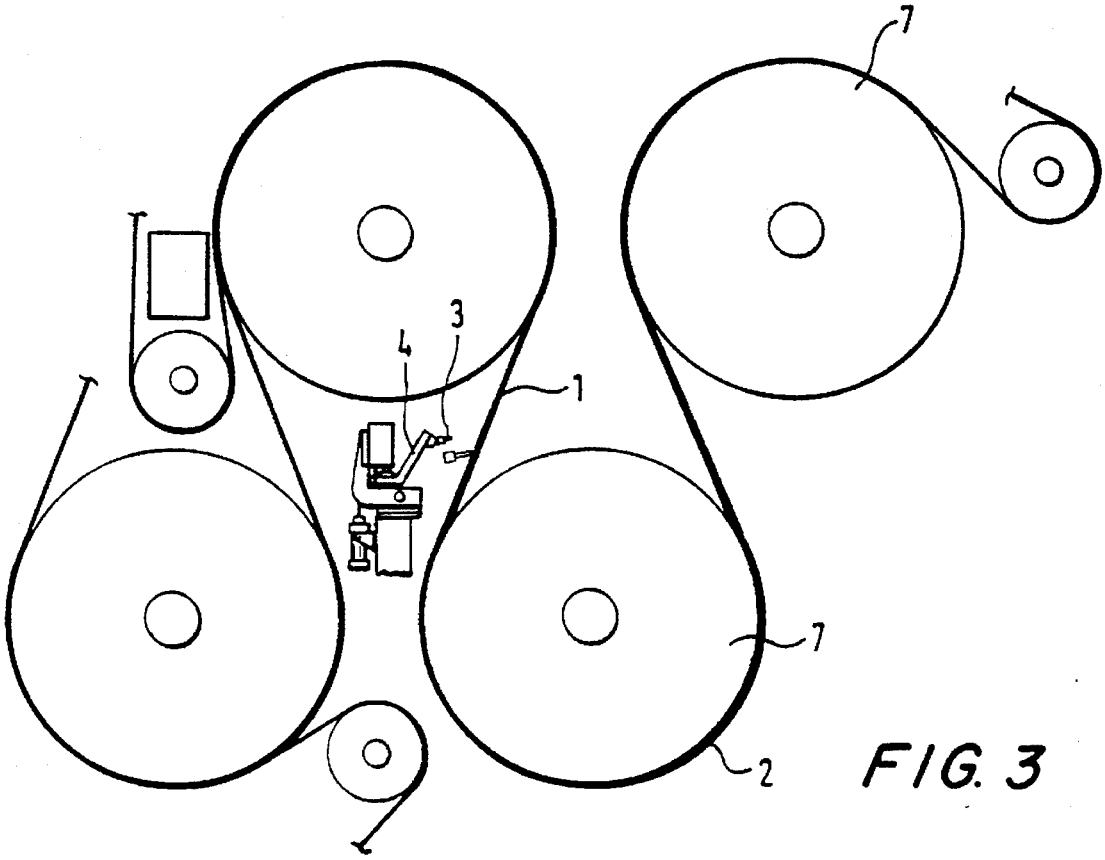
Figure 4:
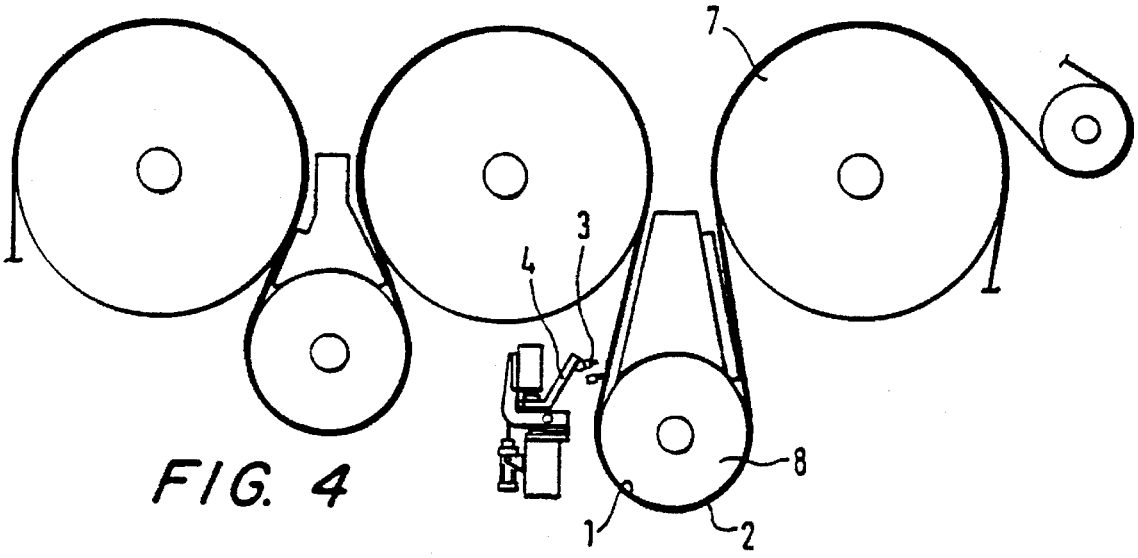
Figure 5:
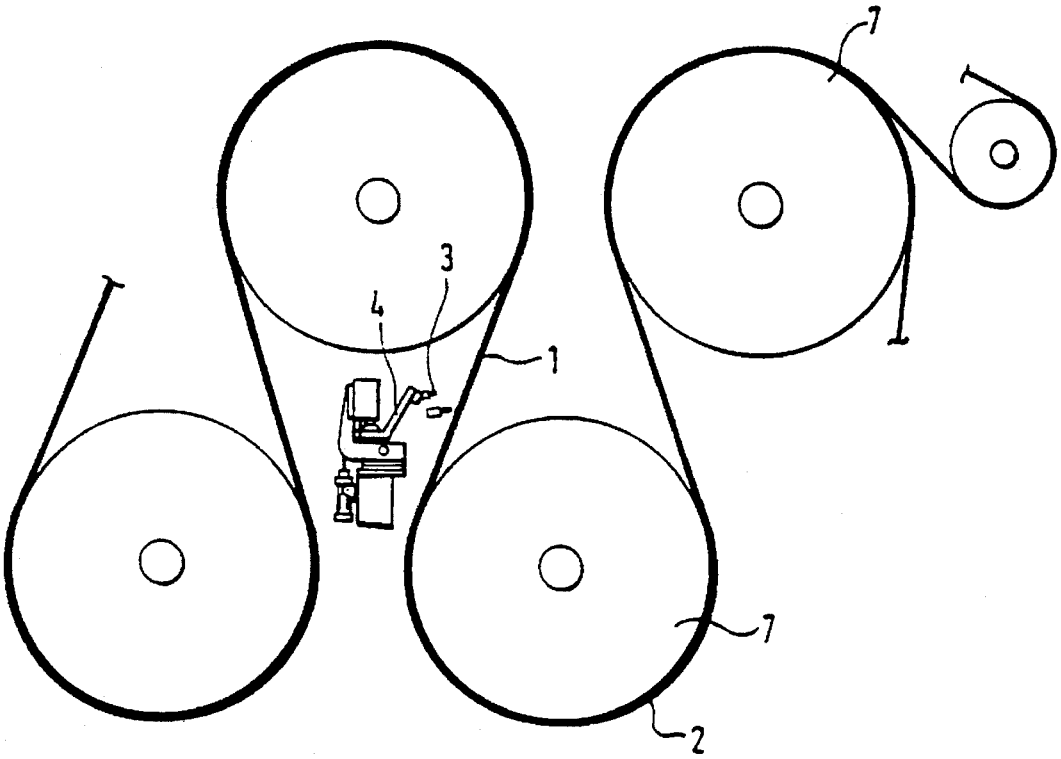

Referring to FIGS. 1–5, a drying wire is denoted with reference numeral 1, a paper or board web to be cut with reference numeral 2, a cutting nozzle with reference numeral 3, a cutter transfer sledge with reference numeral 4, and a cutter transfer beam with reference numeral 5. Drying cylinders are denoted with reference numeral 7, perforated and/or grooved suction roll with reference numeral 8.

In FIG. 1, the nozzle of the cutter device is illustrated when in the rest position of the mechanism, whereas a separate nozzle illustrates its position when the nozzle arm 4 and the nozzle 3 are in the cutting position. The pressure-pump/motor assembly, for pressurizing water and delivering the water to the nozzle, is usually placed at the operating side or at the driving side, from which the water is passed by means of a flexible hose into the nozzle, which moves along with the transfer sledge.

The cutting is carried out by spraying a water jet against the face of the paper web 2 which rests on the drying wire 1, which water jet cuts through the paper web 2 and passes through the drying wire 1 without damaging the wire, while, at the same time, carrying away any fibers separated from the web. The cutting nozzle 3 is guided in a way in itself known from other cutters across the web 2 with a suitable speed distribution so that the result is a web 2 leader and a widening portion of appropriate shape. By means of suitable arrangements, the leader can be cut both in the case of single-wire draw and in the case of twin=wire draw. The cutter can be mounted at a rising or falling side of the web 2.

The diameter of the nozzle 3 for the pressurized water jet is in a range from about 0.1 mm about 1.5 mm, preferably with a Sc grade, the diameter is from about 0.2 mm to about 0.25 mm, with fine paper grades, the diameter is from about 0.3 mm to about 0.35 mm, and with a liner and with other heavy (pulp) webs, the diameter is from about 0.4 mm to about 0.8 mm. The lower limit of the nozzle diameter could also be about 0.15 mm. Most commonly, a nozzle is used whose diameter is at least about 0.1 mm.

Figure 6:
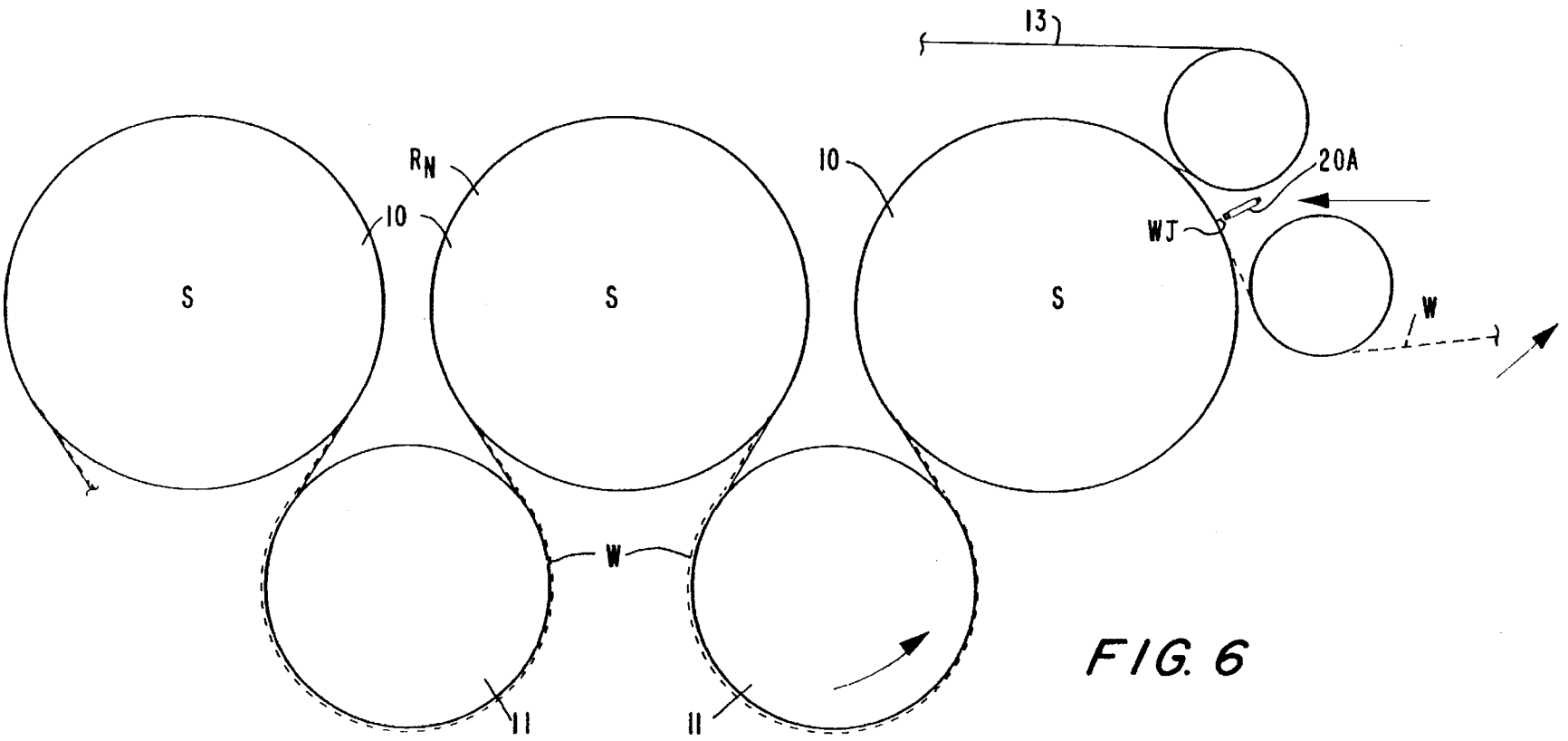
FIGS. 6–12 illustrate dryer sections in which the method and arrangement in accordance with the present invention are applied.
Figure 7:
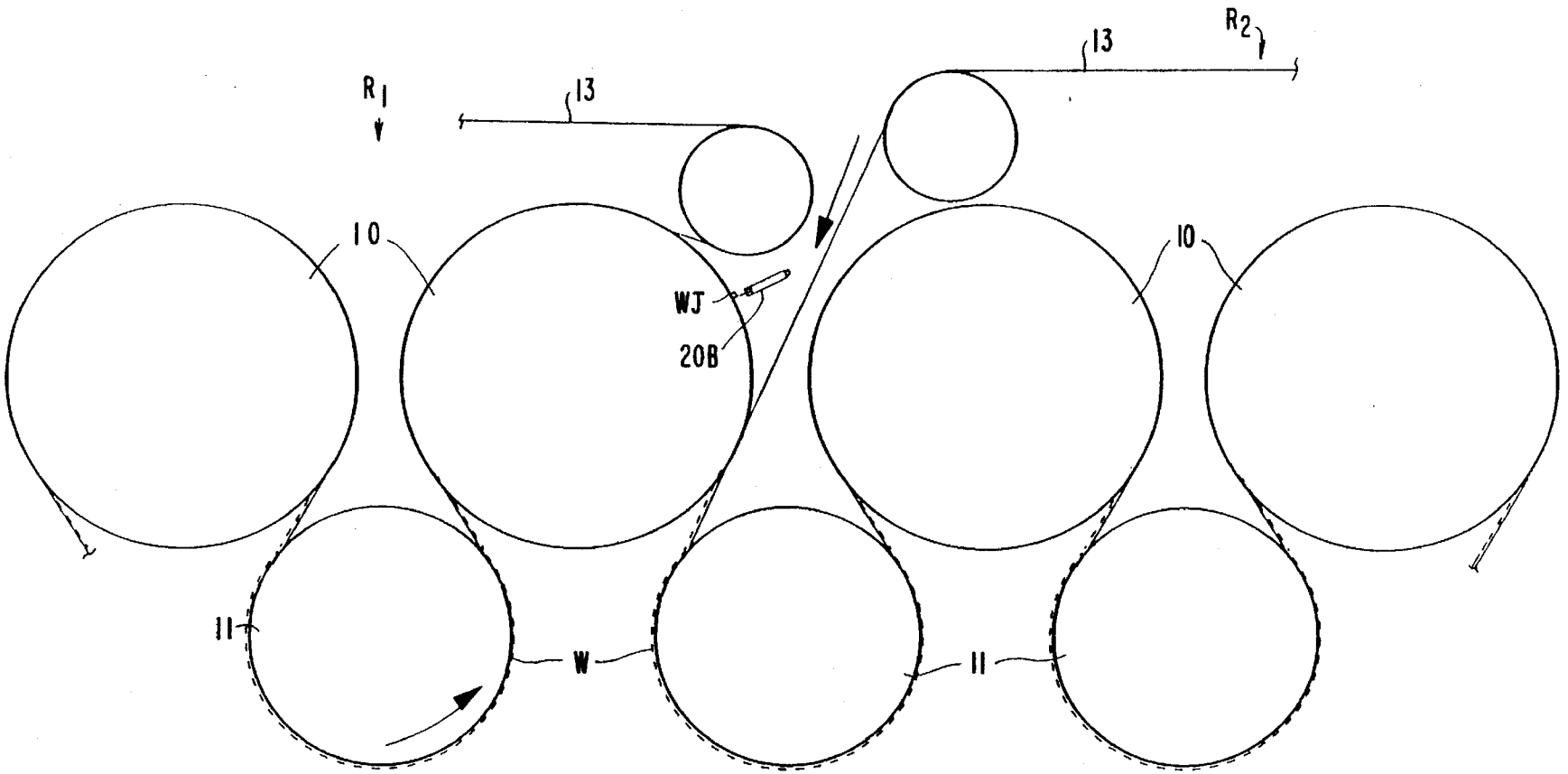

FIGS. 6 and 7 illustrate groups $R_N$ and $R_1$–$R_2$, respectively, with single-wire draw as a field of application of the present invention. Groups $R_N$ and $R_1$–$R_2$ comprise steam-heated upper cylinders 10 arranged in a horizontal row (the upper row), as well as lower reversing suction cylinders 11 arranged in a horizontal row (the lower row) and on which the web W is placed on the drying wire 13 at the side of the outside curve. In FIG. 6, the water-jet nozzle 20A in accordance with the present invention, which cuts the web W, is placed on the sector free of the drying wire 13 on the last cylinder 10 in the group $R_N$. A water jet $W_J$ that cuts the web W is applied from the nozzle 20A against the outer face of the web W that is placed free on the face of the cylinder 10. Since the pressure of the water jet $W_J$ is quite low, the cutting jet $W_J$ does not damage the face of the cylinder 10. Thus, in this embodiment, the web is carried on one of the cylinders after the drying wire has been separated from the web, and the water jet is directed at the web running on that cylinder.

In FIG. 7, the water-jet nozzle 20B is arranged on the free area of the web W that has been arranged on the cylinder 10 between the groups $R_1$ and $R_2$. A group gap is defined between the drying groups $R_1$ and $R_2$ so that the pressurized water jet is directed at the web in the group gap.

Figure 8:
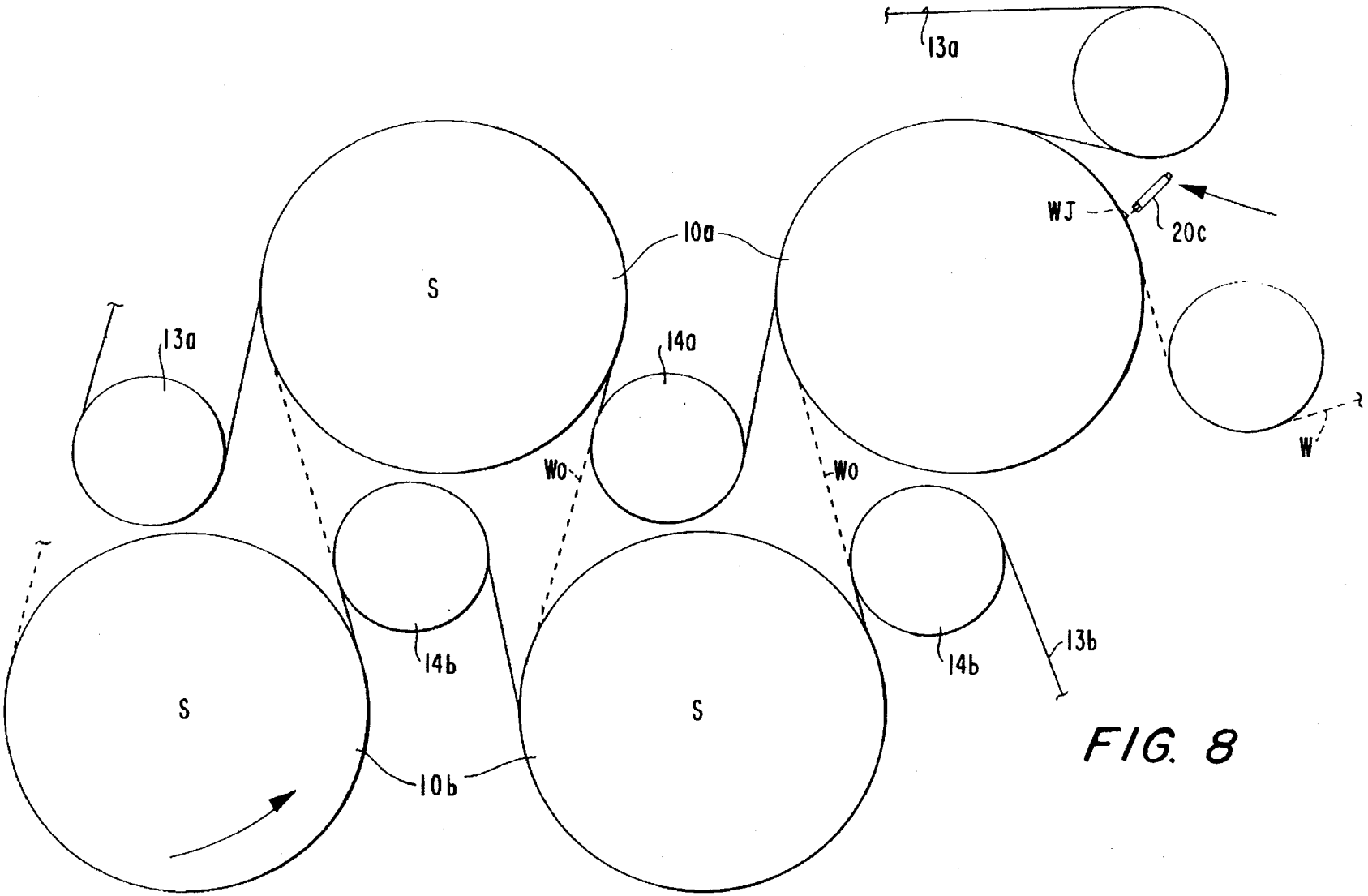
Figure 9:
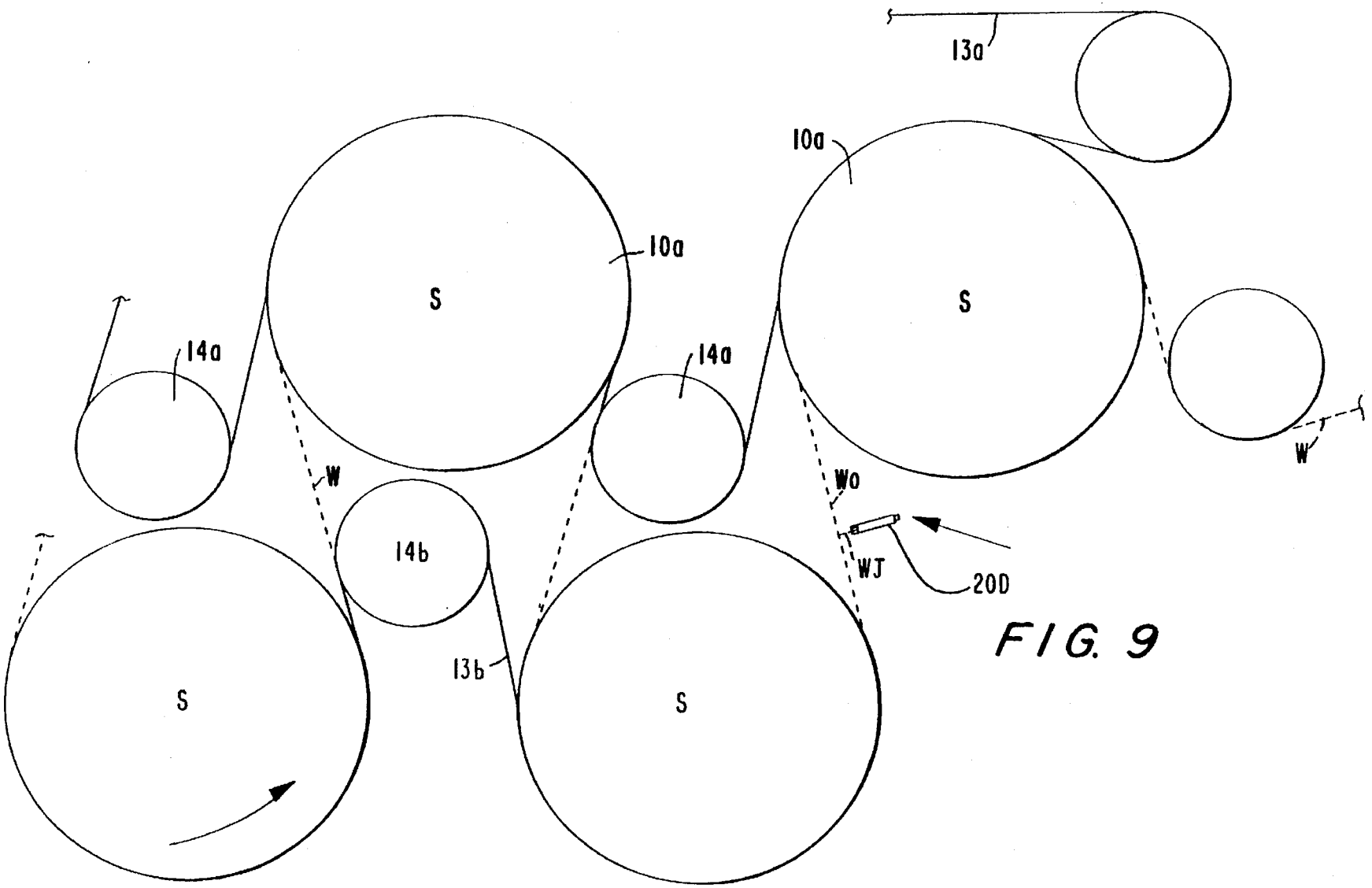
Figure 10:
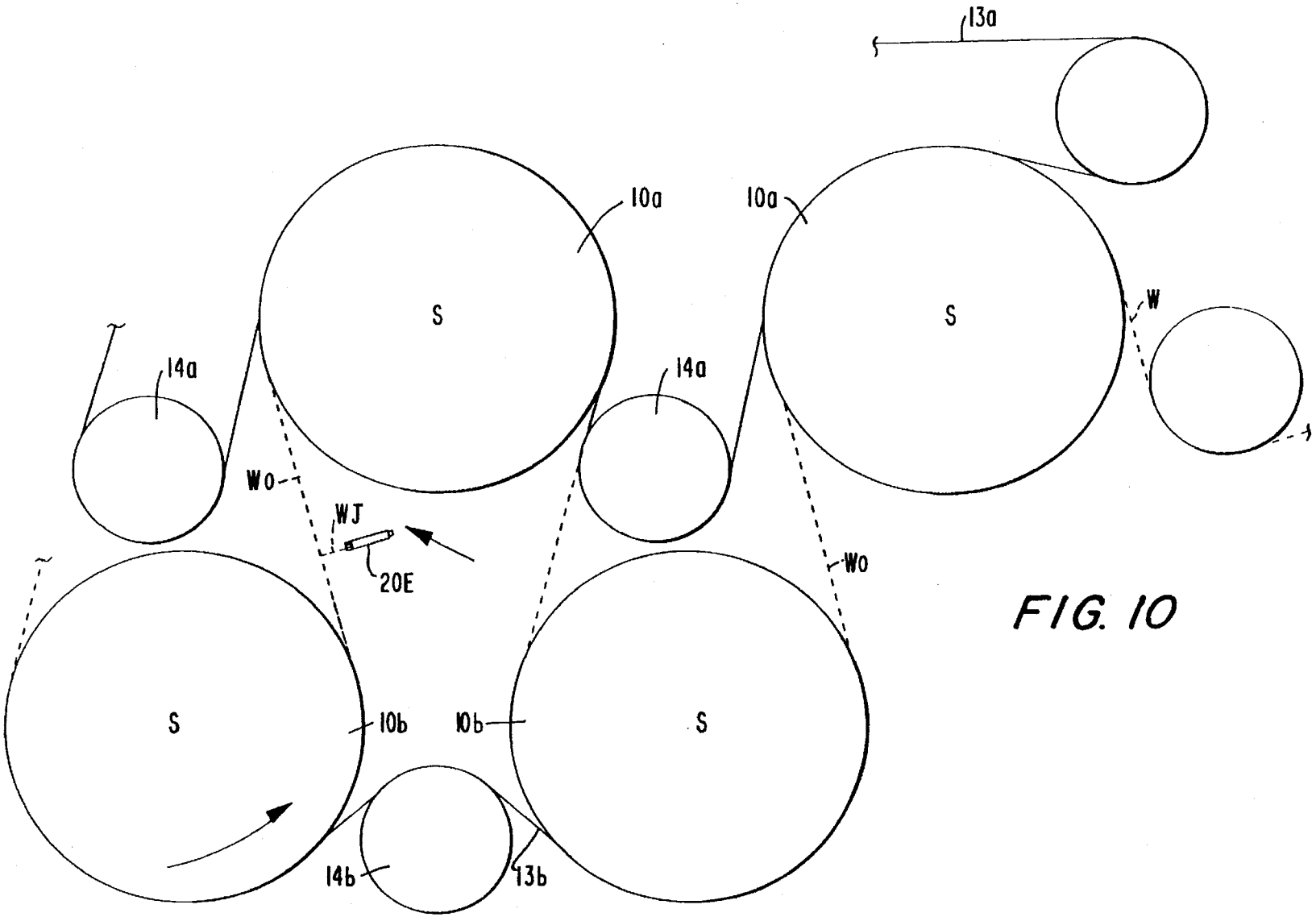

FIGS. 8, 9 and 10 illustrate a cutting device in accordance with the present invention arranged in an area with a twin-wire draw. The groups with twin-wire draw comprise steam-heated upper cylinders 10*a* in an upper row and corresponding steam-heated lower cylinders 10*b* arranged in a lower row, an upper wire 13*a*, which is guided by guide rolls 14*a* placed in the gaps between the cylinders 10*a*, and a corresponding lower wire 13*b*, which is guided by guide rolls 14*b* placed in the gaps between the lower cylinders 10*b*. The guide rolls 14*a* are arranged between adjacent cylinders 10*a* in the upper row and guide rolls 14*b* are arranged between adjacent cylinders 10*b* in the lower row. The web has at least one free draw between the cylinders in said upper row and said cylinders in said lower row.

In FIG. 8, the cutting nozzle 20C is arranged in proximity to the last upper cylinder 10*a* at a location at which the web W to be cut is free from the upper wire 13*a*, i.e., in the free draw.

In FIG. 9, the jet nozzle 20D is arranged on the free draw $W_O$ of the web W between the lower and upper cylinder 10*b*, 10*a* in a group with twin-wire draw, where the web W is not supported by a drying wire 13*a*, 13*b*. In FIG. 10, the cutting nozzle 20E is arranged on the first free draw $W_O$ of the web W in a group with twin-wire draw.

Figure 11:
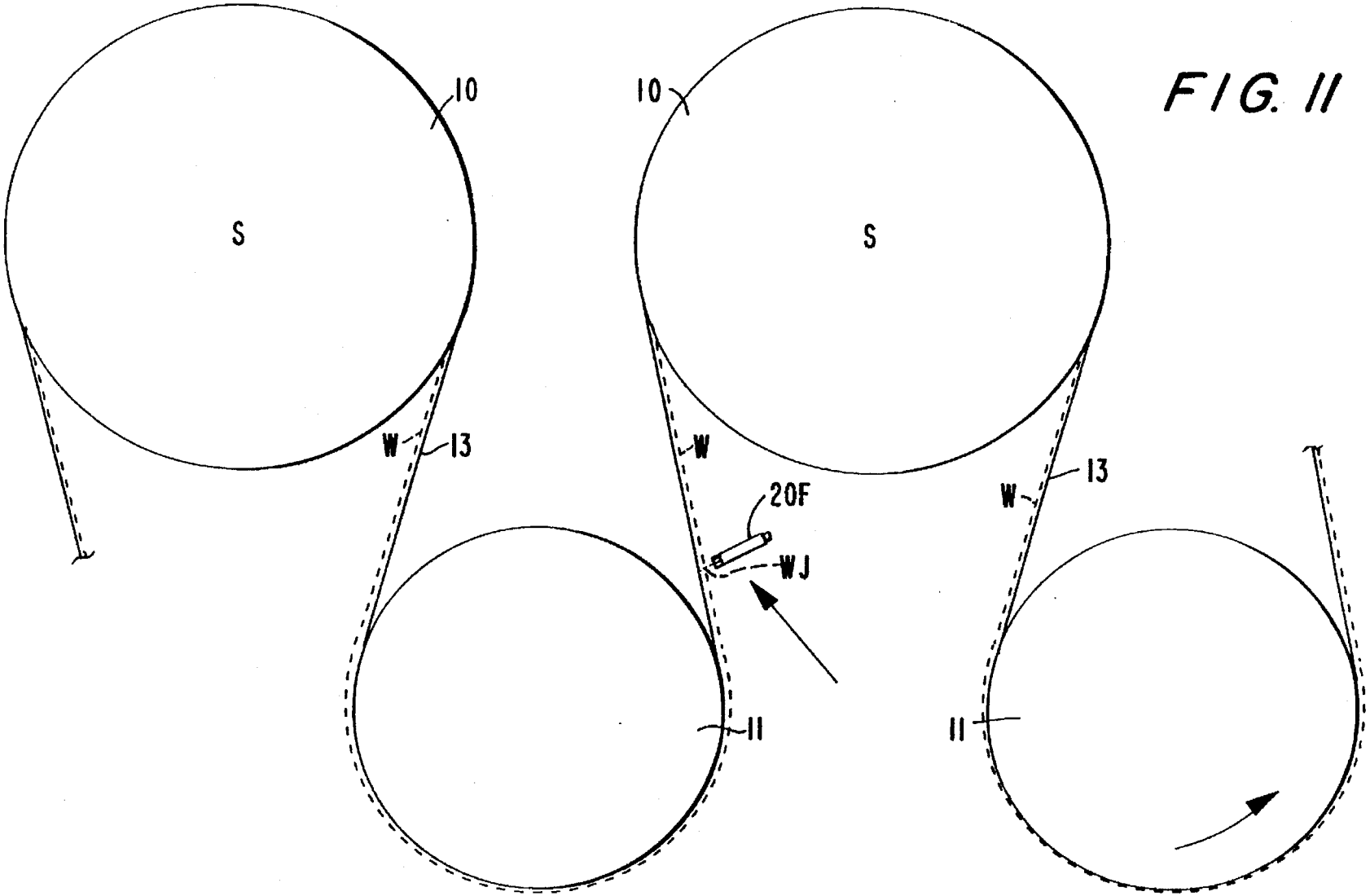

FIG. 11 shows a group with a single-wire draw, in which the drying cylinders 10 are arranged in an upper row and the reversing cylinders 11 are arranged in a lower row. The water-cutting jet 20F is arranged at the side of the web W on the joint straight run of the drying wire 13 and the web W between the reversing cylinder 11 and the drying cylinder 10.

Figure 12:
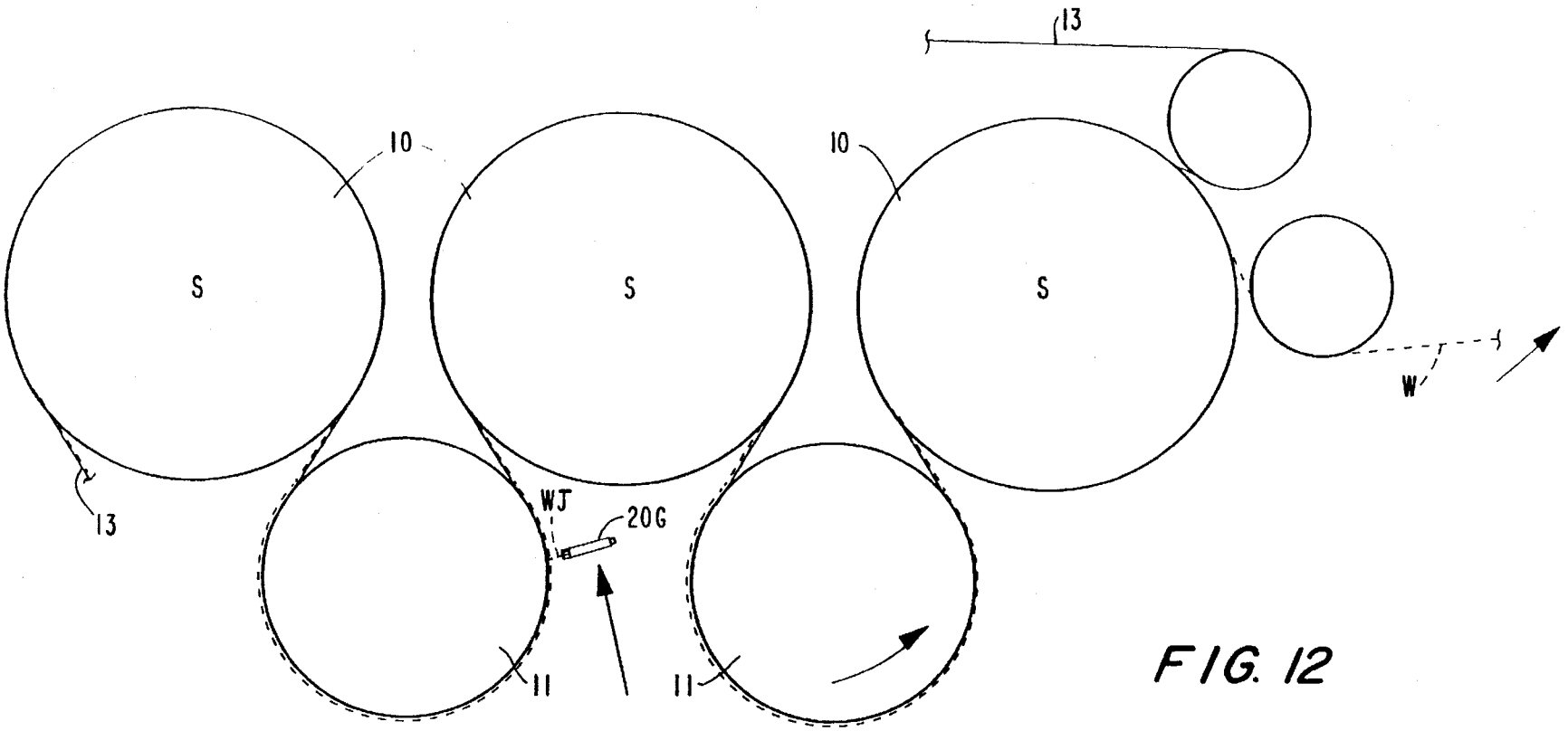

FIG. 12 shows a modification of the embodiment of FIG. 11 in which the water-jet nozzle 20G is placed on the reversing cylinder 11 on a turning sector of the drying wire 13 and of the web on which the web W to be cut is placed at the side of the outside curve of the reversing roll.

Figure 13:
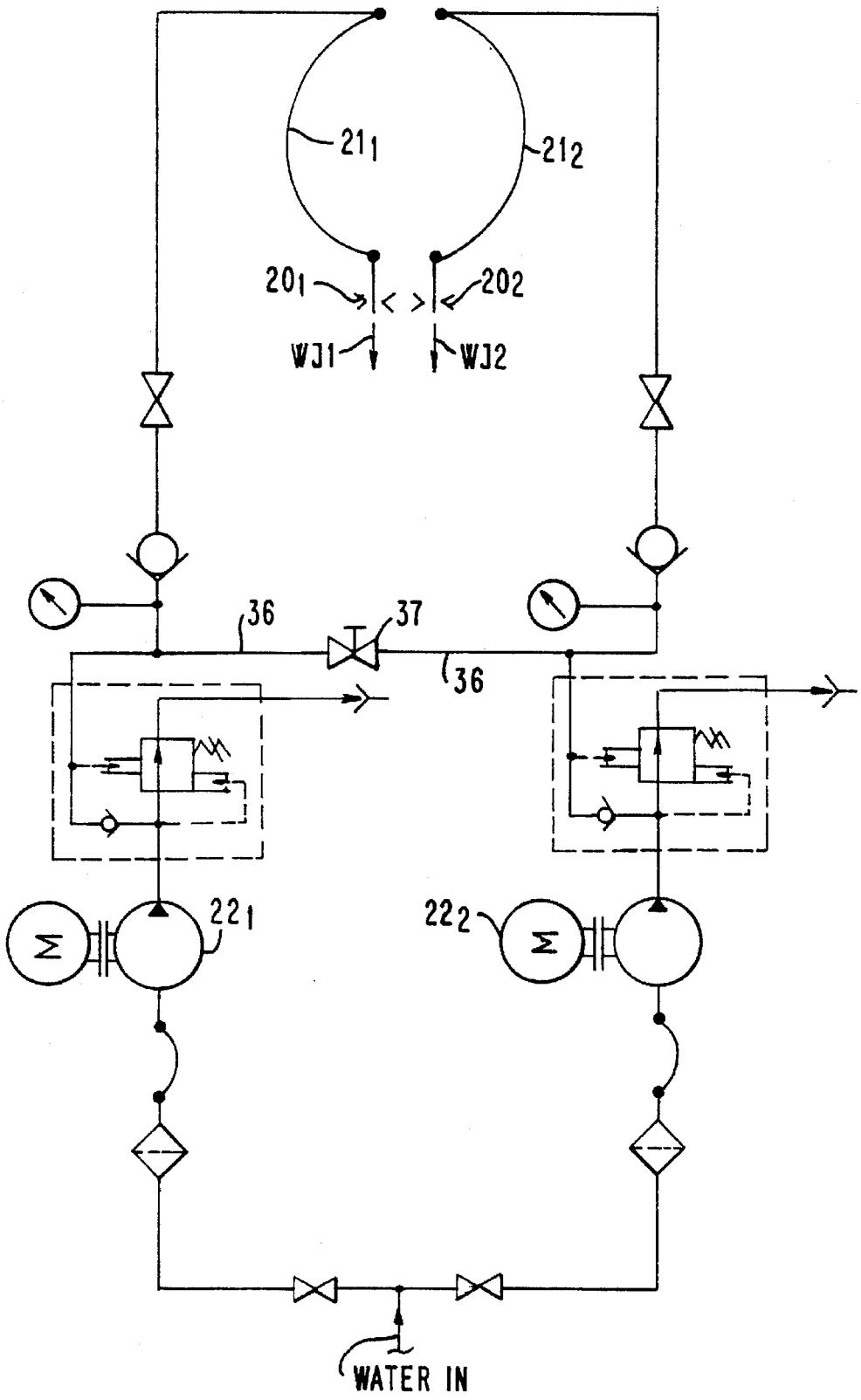
FIGS. 13 and 14 illustrate pumping arrangements to pump pressurized water to the cutting nozzles in accordance with the present invention.
Figure 14:
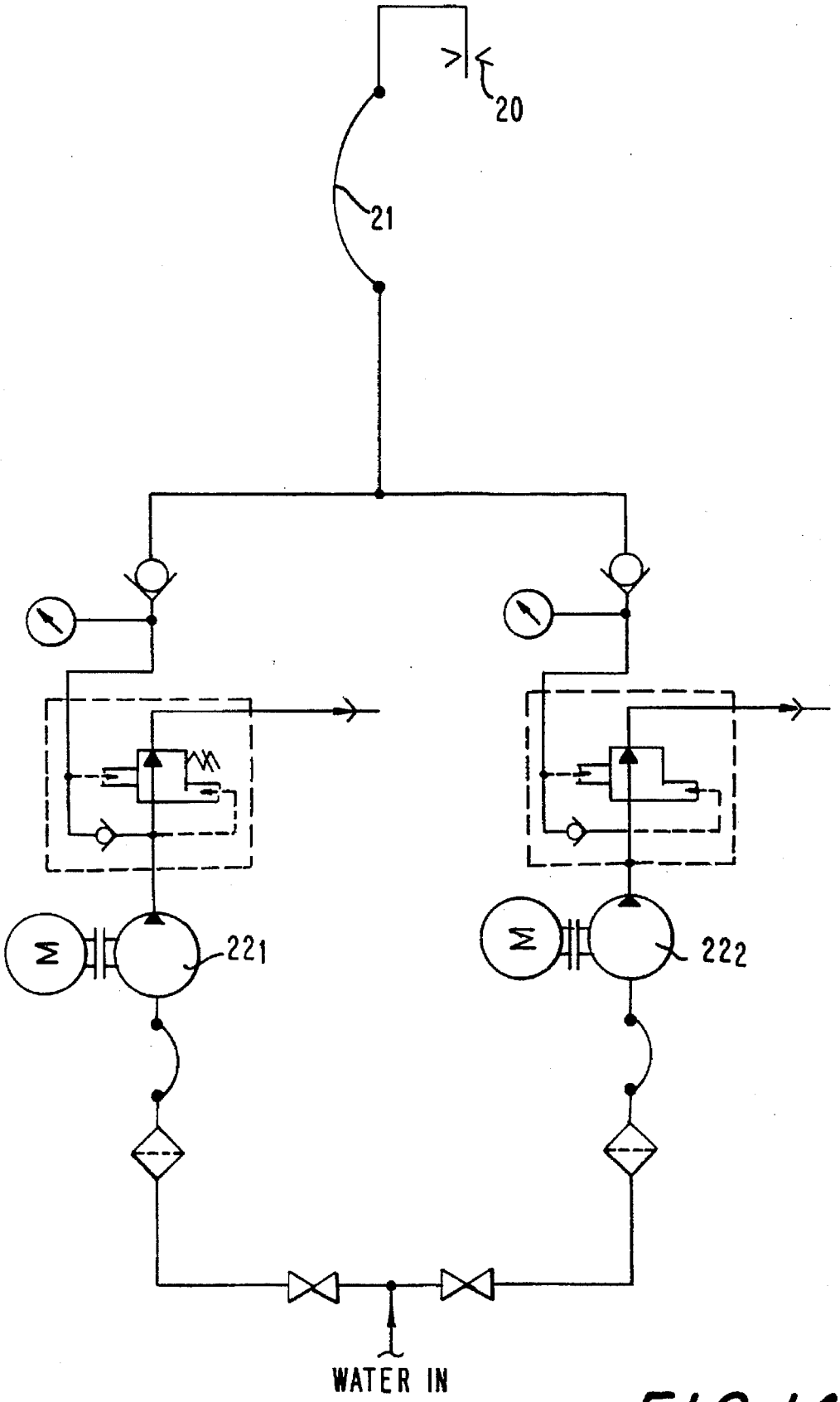

FIGS. 13 and 14 show a hydraulic diagram of a double system in accordance with the present invention. Referring to FIG. 13, water is fed into the cutting device by means of pumps $22_1$ and $22_2$ through two fully parallel systems, so that, in the device there are two nozzles $20_1$ and $20_2$. Nozzles $20_1$ and $20_2$ are placed close to each other, for example one after the other, so as to operate at the same time or alternatingly by means of a valve. Pressure water, or other pressurized fluid, is passed into the nozzles $20_1$ and $20_2$ from the hoses $21_1$ and $21_2$, and the cutting jets $WJ_1$ and/or $WJ_2$ are discharged out of the nozzles $20_1$ and/or $20_2$. Thus, in this embodiment, two cutting nozzles are arranged in parallel to one another, and two pumps are provided to pressurize water and direct the pressurized water to respective cutting nozzles.

The double hydraulic system also includes a shunt pipe 36 and a valve 37 arranged therein. The pipe 36 and valve 37 enable either pump $22_1$ or $22_2$ to feed either or both of the nozzles $20_1$,$20_2$. Valve 37 may be controlled by means of the same signal by which the operating pump $22_1$ or $22_2$ is selected. In this manner, a very reliable operating system is established by means of which the system operates even if one of the pumps $22_1$,$22_2$ or nozzles $20_1$,$20_2$ fail.

FIG. 14 shows a system in which there is a partial double system which comprises parallel pumps $22_1$ and $22_2$ and a common water hose 21 and jet nozzle 20.

Figure 15A:
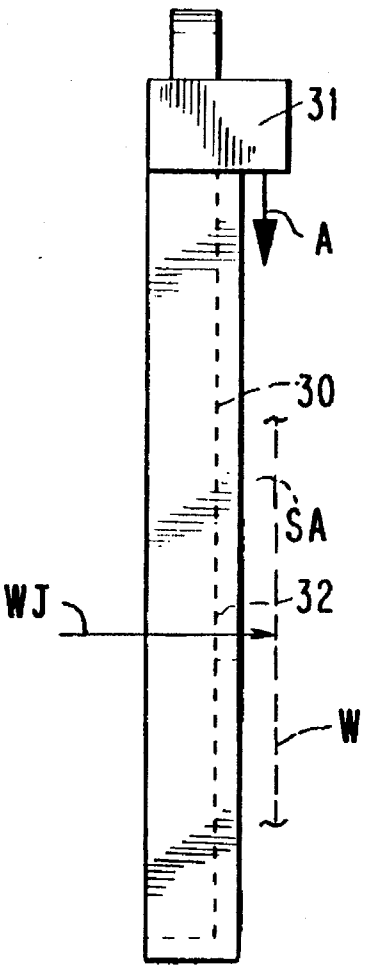
FIG. 15A is a side view of the web guide plate shown in FIG. 15.
Figure 15:
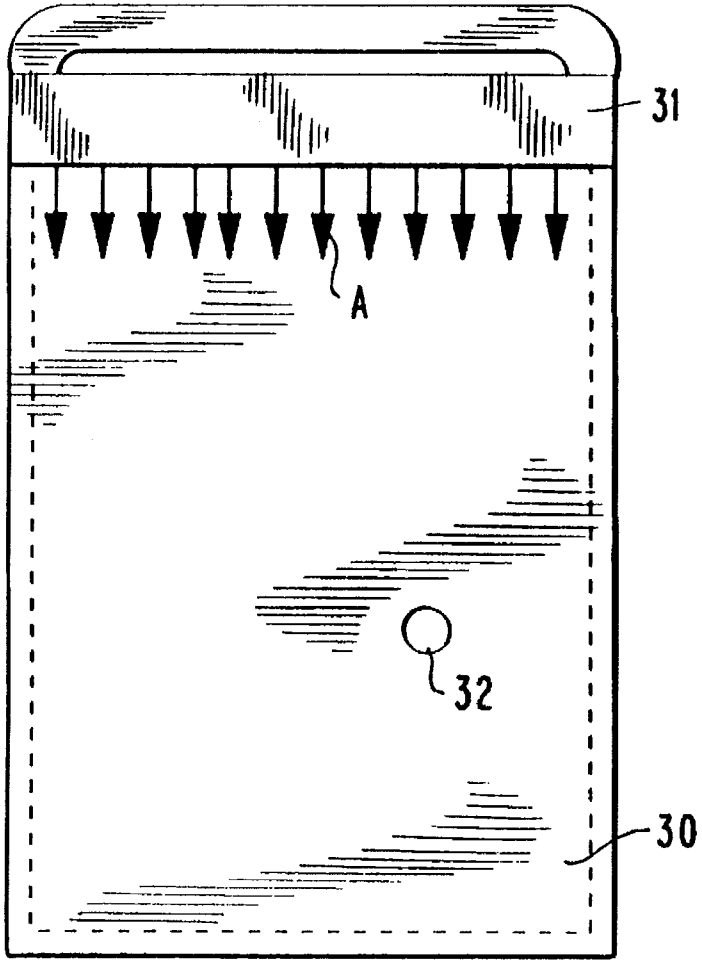
FIG. 15 illustrates a web guide plate for use in the present invention.

FIGS. 15 and 15A shows a web guide plate 30 for a water-cutting device in accordance with the present invention. At an inlet side of the plane guide plate 30, in the running direction of the web W, there is a nozzle slot or a series 31 of nozzle openings, through which an air jet A is blown in a direction substantially parallel to the plane of the plate 30 and along the plate. In this manner, a dynamic area SA of negative pressure is produced which stabilizes the web W in connection with the plate 30. Through a hole 32 that has been formed in the plate 30, a jet WJ of cutting water is applied perpendicularly to the plane of the plate 30. The guide plate 30 keeps the web W reliably in the cutting position by the effect of the area SA of negative pressure, i.e., suction. Other stabilizing means or suction devices may also be used in accordance with the invention.

Figure 16A:
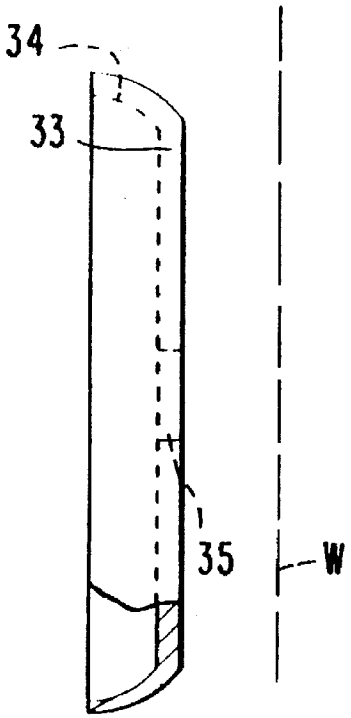
FIG. 16A is a partially sectional side view of the web guide plate shown in FIG. 16.
Figure 16:
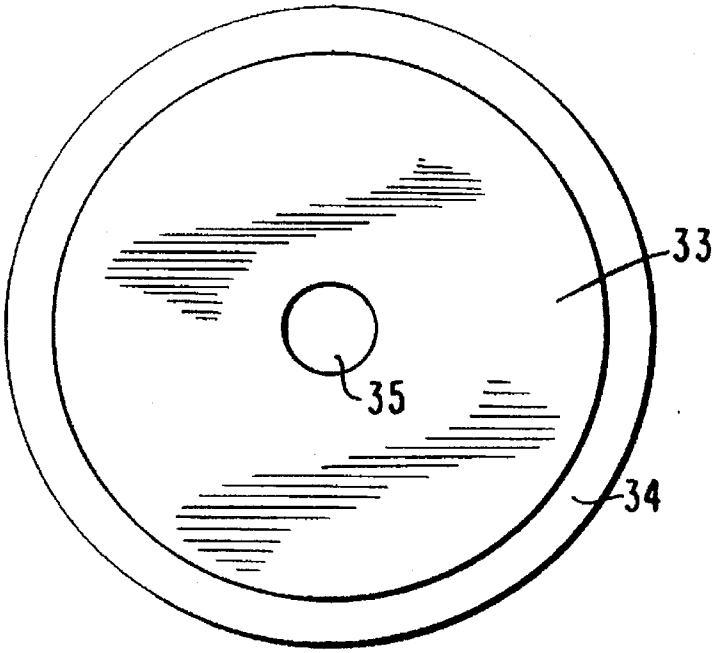
FIG. 16 illustrates a web guide plate for use in the present invention.

FIGS. 16 and 16A shows a disc-shaped guide plate in which there is a plane central part 33 and rounded edge portions 34. A cutting-water jet WJ is applied to the web W through the central hole 35 in the central part of the plate 33.

Figure 17:
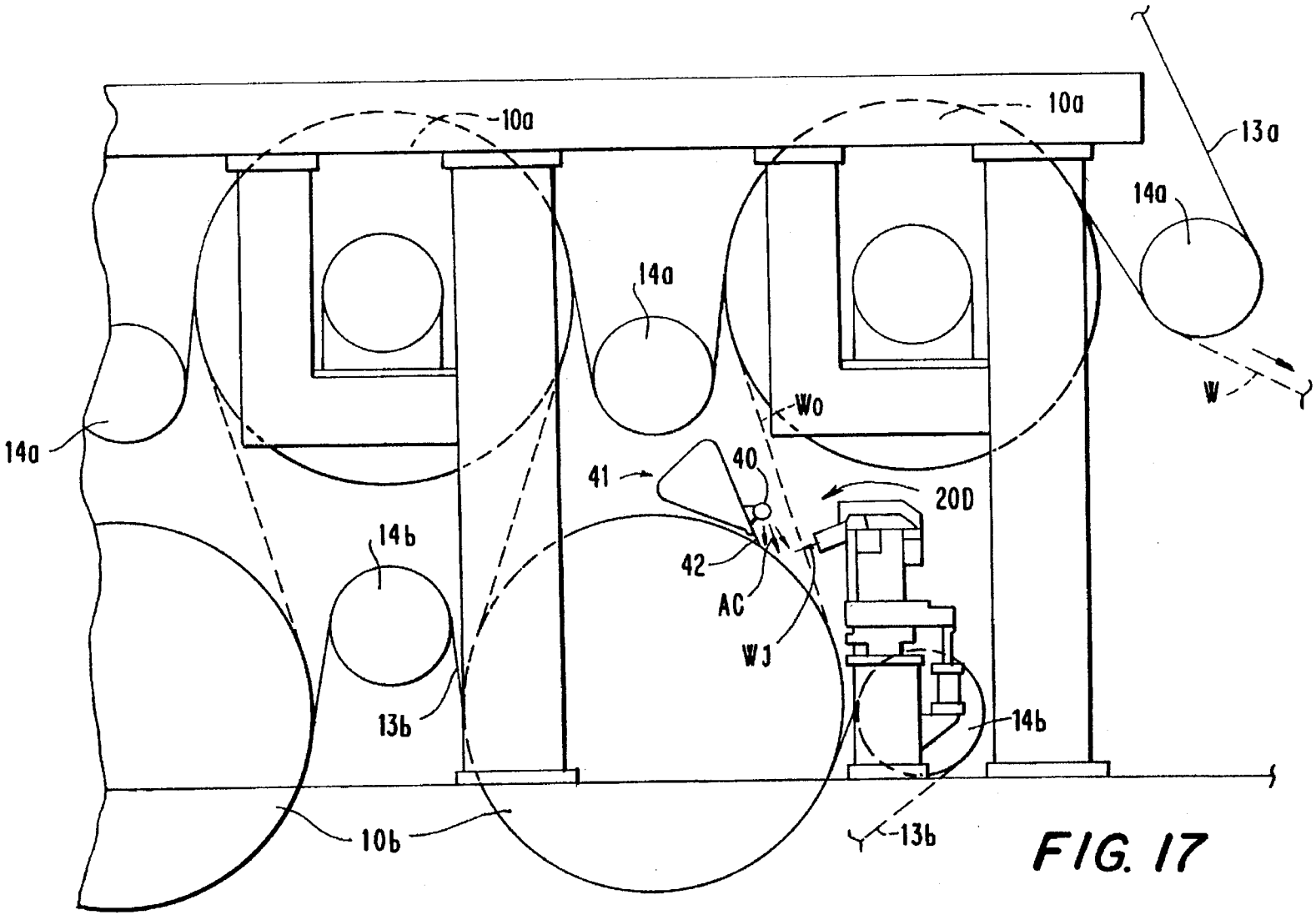
FIG. 17 illustrates another embodiment of a dryer section in which the method and arrangement in accordance with the present invention are applied.

FIG. 17 shows a method for removing cutting waste (paper chips and dust) produced in the cutting process of the paper web. The paper web W is cut by means of a water cutter 20D in the free draw $W_0$ of the web as it runs between cylinders $\mathbf{10}_a$,$\mathbf{10}_b$. An air jet AC is directed from a jet pipe 40 to the paper particles produced in when the web is cut, i.e., at an opposite side of the web from the water cutter 20D. Air jet AC moves the particles on that side of the web away from the web. Jet pipe 40, from which the air jet AC is applied, can be connected to a doctor beam 41 in close proximity to a doctor blade 42. The doctor blade 42 serves to detach any paper particles from the surface of roll 10*b*.

All of the above-described embodiments of the paper-tail cutting device and method in accordance with the present invention can be controlled either from a separate desk, from switches placed at the side of the paper-tail cutting device, or by means of the operation logic of the paper machine, for example the control computer, such as DAMATIC XD®. When the paper-tail cutting device is in the rest position, the cutting head is placed at the edge at the driving side, and, if the beam is provided with a tilting mechanism, the beam for paper-tail cutting is turned away from the cutting position. In a corresponding manner, the rest position of the cutting head may also be placed at the tending side. When the paper-tail cutting is started, the cutting nozzle placed on the sledge for paper-tail cutting is run to the paper-tail cutting position "normal-run selection/SS", where it is positioned automatically by means of the limit switches provided on the beam for paper-tail cutting. The switches may be, e.g., contact switches, electromagnetic switches, or optical limit switches in the area of the beam, or a so-called revolving limit switch at the end of the beam. Generally, the speed of the sledge for paper-tail cutting is slowed down before it is positioned in the position for paper-tail cutting. After this reduction in speed, the pre-set width of the paper tail can still be changed by means of manual run. The cutting head can be brought to the servicing position by running the "service run/SS".

The cutting of the paper tail is started by switching the paper-tail "cutting" on via the control desk. In this case, the beam for paper-tail cutting is pivoted to the cutting position (if it is pivotal), and the high-pressure pump is started. Water strikes from the nozzle against the web and pierces through the web, whereby the leader strip is cut apart at the edge of the web. The leader strip is guided by means of ropes, blowing of air, or manually to the next device, which may be, e.g., a calender, Sym-Sizer, a pope reel, Opti Reel®, or a dryer section.

After the leader strip runs further, "spreading" is switched on via the control desk or from the logic, in which case the sledge for paper-tail cutting starts running towards the driving side while pressurized water cuts through the web. In this manner, the leader strip can be spread to full width of the web in accordance with the commonly known principle. When the sledge for paper-tail cutting bypasses the limit switch at the driving side, which switch is placed at the proximity of the web edge, the high-pressure pump and the transfer motor of the sledge for paper-tail cutting are switched off. The transfer motor is a pneumatic motor or an electric motor which is provided with speed regulation and with thermistors (preferably an electric motor). In the case of a beam that can be tilted, the beam is also pivoted to the rest position.

It is an important feature of the present invention that the high-pressure water is produced in the high-pressure center, in which there are one, two or more pumps. In a preferred embodiment, only two pumps are used. The water that is used is condensate water or tap water. The pressure of the supply water is adjusted to the correct level by regulation means, e.g., a pressure reduction valve (valves), which is/are common of all the pumps or a valve of its own for each pump. In a preferred embodiment, there is a separate reduction valve for each pump. For each pump, there is a separate filter in which the filtering grade from about 0.5 μm abs. to about 50 μm abs. The filters may be provided with pressure-difference guards or, with a pressure guard arranged after the filter in the water line passing to the pump. A failure report arrives from the pressure guard in a manner that is normal in a paper machine, mostly on the monitor screen, from which a print can be produced. The pressure-difference guard or the pressure guard prevents starting of the pump without water and controls the starting to another pump, either automatically or by means of manual selection carried out by means of the control. The pressure-difference guard reports blocking of a filter, and the pressure guard reports generally the absence of water to be supplied to the pump, i.e., indirectly, also blocking of a filter.

The pumps are of the type of a plunger pump or a piston pump, preferably and commonly a plunger pump. The pump is driven by, e.g., an electric motor, by means of a v-belt, a flat-belt, or a gear transmission. The pressure range of the pumps is preferably from about 100 bar to about 350 bar. The pumps have all-ceramic or ceramic-coated pistons/plungers.

After the pumps, there is at least one pressure regulation valve by whose means the pressure produced by each pump or by all the pumps is regulated to the level necessary for the cutting.

In a normal case, during paper-tail cutting, only one of the pumps is in operation. If a disturbance occurs in the pump that is in operation, the next pump is started, either automatically or by selecting it through the control system of the machine (e.g. Damatic as described above). For the pumps, it is possible to regulate different pressures, in which case, for one of the pumps, a higher pressure is regulated for heavy paper grades. This pump is chosen as the pump that produces high-pressure water when a web is present that has a high grammage or a more demanding pulp structure. The pressure regulation valve also keeps the water consumption at the correct level by means of a by-pass flow, so that the pump does not have to pump water against an obstacle. This increases the service life of the pump considerably.

After the pressure-regulation valve, there is a pressure gauge for measuring pressures in a range from 0 to about 400 bar.

From the pressure center, the high-pressure water is passed along a pipe and/or a hose to the cutting nozzle.

Inside the paper machine, a heat-resistant teflon hose is used for the transfer of the high-pressure water.

When the method is used in a drying section for paper-tail cutting in the cutting of the lateral strips, even though, when the cutting is performed against the wire, the quality of the edge cutting result is near the limits of what is acceptable. When the cutting is carried out against a cylinder and at a free gap, no wire marking is produced and the cutting result is quite good.

The cutting of the paper tail at a low pressure is also important when performed at a free gap. In the prior art, the devices utilizes a much larger pressure which is one order higher than that used in the present invention, e.g., from about 1050 bar to about 1400 bar, which is produced by means of a pressure intensifier and not a plunger pump.

The reserve system may be a completely separate system, so that, from the reserve pump, there is a double line to the reserve nozzle, which may be taken to use by opening the valve of said line and switching on the reserve pump. The valve of the line may be placed either on the sledge for paper-tail cutting at the side of the machine or on the pump unit.

The examples provided above are not meant to be exclusive. Many other variations of the present invention would be obvious to those skilled in the art, and are contemplated to be within the scope of the appended claims.

We claim:

1. A dryer section in a paper or board machine including an arrangement for cutting at least one of a leader of a web and a diagonal tail portion of a web, the dryer section comprising a plurality of cylinders, at least one drying wire for carrying a web over said cylinders, the web having first and second opposed faces, at least one of said cylinders and said at least one drying wire in the dryer section being structured and arranged to support the web in a run along which said first faces of the web is in contact with said at least one drying wire and said second face of the web is exposed, and water jet means arranged in opposed relationship to said second face of the web along said supported run of the web in which said first face of the web is in contact with said at least one drying wire and said second face of the web is exposed for directing a pressurized water jet at said second face of the web to cut the web and said at least one drying wire, said water jet having a pressure from about 40 bar to about 400 bar.

2. The dryer section of claim 1, wherein the pressure of the water jet is in a range from about 100 bar to about 350 bar.

3. The dryer section of claim 1, further comprising a pump to pressurize water and direct the pressurized water to said water jet means.

4. The dryer section of claim 1, further comprising a plate having nozzles through which an air jet is directed in a direction substantially parallel to a running direction of the web to stabilize the web, the water jet being directed at the web through an aperture in the plate.

5. The dryer section of claim 1, wherein said water jet means comprise a cutting nozzle, said cutting nozzle having a variable diameter depending on the type of web being cut.

6. The dryer section of claim 5, wherein the diameter of the cutting nozzle is from about 0.1 mm to about 1.5 mm.

7. The dryer section of claim 5, wherein the diameter of the cutting nozzle for use with Sc grades is from about 0.2 mm to about 0.25 mm.

8. The dryer section of claim 5, wherein the diameter of the cutting nozzle for use with fine paper is from about 0.3 mm to about 0.35 mm.

9. The dryer section arrangement of claim 5, wherein the diameter of the cutting nozzle for use with liner and heavy pulp webs is from about 0.4 mm to about 0.8 mm.

* * * * *